United States Patent [19]

Marotto

[11] 4,122,885

[45] Oct. 31, 1978

[54] VENETIAN BLIND TILTER CLUTCH

[75] Inventor: Anthony F. Marotto, Philadelphia, Pa.

[73] Assignee: Marathon Manufacturing Company, Houston, Tex.

[21] Appl. No.: 849,415

[22] Filed: Nov. 7, 1977

[51] Int. Cl.[2] ..... E06B 9/26

[52] U.S. Cl. ..... 160/176 R; 64/30 R

[58] Field of Search ..... 160/166–178; 64/30 R, 30 C

[56] References Cited

U.S. PATENT DOCUMENTS

| | | | |
|---|---|---|---|
| 1,516,152 | 11/1924 | Dumont | 64/30 R |
| 2,137,444 | 11/1938 | Clancy | 160/175 |
| 2,176,259 | 10/1939 | Guy | 160/176 |
| 3,192,740 | 7/1965 | Stamates | 64/30 R |
| 3,789,905 | 2/1974 | Saito | 160/176 |

*Primary Examiner*—Peter M. Caun

*Attorney, Agent, or Firm*—Robert K. Youtie

[57] ABSTRACT

A venetian blind including a rotary tilt rod and tilt rod operator, wherein a yieldable or slip coupling is interposed in motion transmitting relation between the operator and tilt rod to disengage the same upon excessive torque, the coupling including driving and driven elements respectively connected to the operator and tilt rod and having separable interfitting formations configured to effect driving engagement and urge the elements and formations apart, and a resilient device yieldably urging the elements and formations toward each other.

9 Claims, 4 Drawing Figures

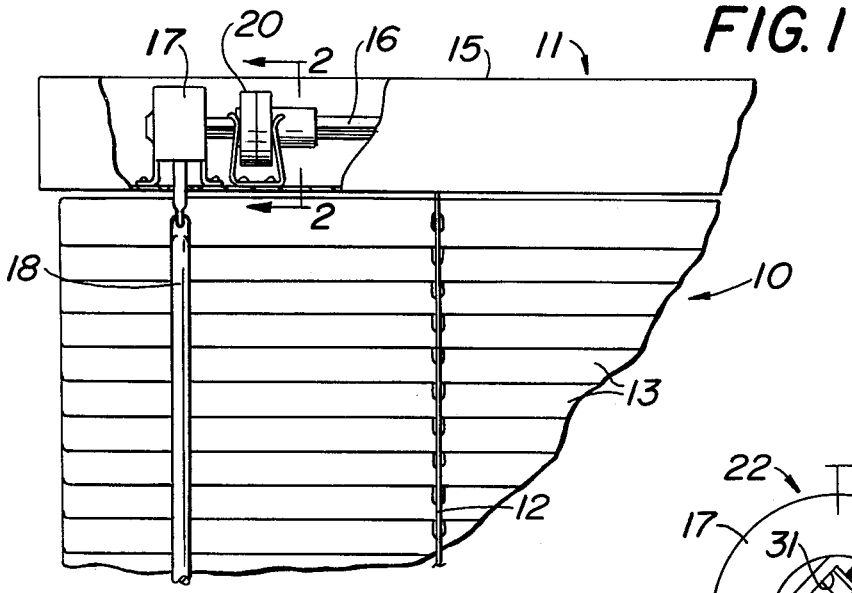
FIG. 1
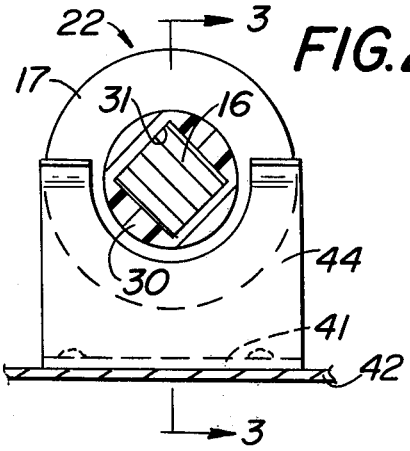
FIG. 2
FIG. 3
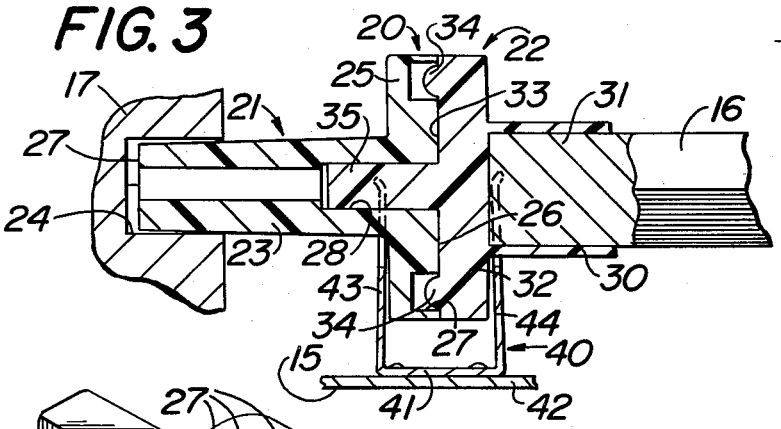
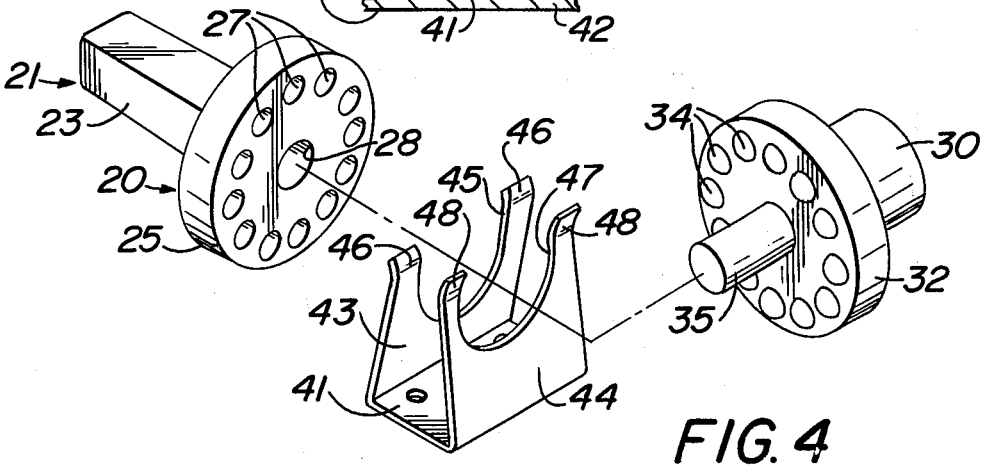
FIG. 4

VENETIAN BLIND TILTER CLUTCH

BACKGROUND OF THE INVENTION

In many venetian blind constructions, as is well known to those versed in the art, there is advantageously provided an automatically disengaging connection between the manual tilter actuation means and the slats. Such disengaging means may prevent excessive force in being applied to slats and ladders, as well as to internal stop mechanisms, if such are used. Also, such slip coupling means may avoid the need for overriding worm-and-wheel gearing, and permit of extremely simple cord length equalizing, if desired.

However, prior venetian blind slip couplings were relatively complex in construction, expensive in manufacture, subject to damage and malfunction, and difficult and tedious to install.

SUMMARY OF THE INVENTION

Accordingly, it is an important object of the present invention to provide a venetian blind tilt mechanism slip coupling which overcomes the above mentioned difficulties, is extremely simple in construction and manufacture, requiring a minimum of parts, being staunch and sturdy in design and well adapted for durability and reliability throughout the full life of a venetian blind.

It is another object of the present invention to provide a venetian blind tilt mechanism coupling or clutch having the advantageous characteristics mentioned in the preceding paragraph, which is very economical in manufacture, and extremely simple to install in a venetian blind, so as to add but a modicum to the cost.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a partial elevational view showing a venetian blind in operative condition, and partly broken away to illustrate the improved structure of the instant invention.

FIG. 2 is a partial transverse sectional view taken generally along the line 2—2 of FIG. 1, enlarged for clarity.

FIG. 3 is a partial sectional view taken generally along the line 3—3 of FIG. 2.

FIG. 4 is an exploded perspective view showing components of the instant invention.

DESCRIPTION OF THE PREFERRED EMBODIMENT

Referring now more particularly to the drawings, and specifically to FIG. 1 thereof, a venetian blind is there generally designated 10, and includes an upper, generally horizontal head assembly 11, from which depend a plurality of ladders 12, supporting a plurality of vertically superposed slats 13.

The head assembly 11 includes an upwardly opening headrail or channel 15, and mounted in the headrail or channel 15, extending longitudinally therein is a rotatably supported tilt rod 16. The tilt rod 16 is journaled for generally axial rotation, and connected, by any suitable means, to ladders 12 for effecting movement of the latter and tilting of slats 13 upon rotary oscillation of the tilt rod.

A tilt operator is designated 17, also mounted in the channel or headrail 15, usually at one end of the latter, and may include worm-and-wheel gearing, or other conventional tilt operating means for rotating the tilt rod 16.

Suitable manually actuable slat tilting means may be provided, such as a rotary operating rod or wand 18 depending from the tilt operating means 17. Of course, any suitable manually actuable tilt operating means may be employed, such as a flexible element or cord, as desired.

Interposed between the tilt operating means 17 and rotary tilt rod 16 is a slip coupling or clutch, generally designated 20, constructed in accordance with the teachings of the present invention. The clutch or coupling 20 is best seen in FIGS. 3 and 4, from which it will be apparent that the coupling includes a pair of coupling members 21 and 22 in driving and driven relation, respectively. More specifically, the clutch member 21 may be considered as a drive element, being driven by rotation of the tilt operator 17, and the coupling member 22 may be considered as a driven element, being driven by the drive element, and in driving relation with the tilt rod 16.

More particularly, the drive element 21 may include a shaft or shank 23, advantageously of noncircular cross sectional configuration for nonrotative engagement in a similarly configured recess or bore 24 of tilt operator 17. In practice, the tilt operator bore 24 may be of generally polygonal or square cross sectional configuration, and the shank or stem 23 may be of a similar polygonal square or cross section configuration, and tapering outwardly for convenient entry into bore 24. Remote from the tilt operator 17, the shaft or stem 23 is provided with an enlargement 25, say in the form of a circular disc or plate disposed generally concentric with respect to and normal to the axis of shank or shaft 23. The circular plate or disc 25 is provided on its face 26, facing away from the shaft 23, with an annular array of blind holes, bores or receivers 27, being illustrated as 12 in number in FIG. 4, and located in concentric relation with respect to the axis of shaft 23. Additionally, there is provided a generally circular bore or recess 28, extending inwardly from the face 26 of the enlargement 25, axially thereof and axially into the shank 23, terminating short of the free shank end 27.

The driven member 22 includes a hollow shaft or shank 30, located in axial alignment with the shaft or shank 23, and opening oppositely away from the latter shaft. In particular, the hollow shaft 30 is provided with an interior longitudinal bore 31 of noncircular cross section for conformably and nonrotatably receiving the adjacent end of noncircular tilt rod 16. The shaft or shank 30 is provided on its end proximate to the enlargement 25, with an enlargement 32, which may assume the form of a generally circular disc or plate disposed generally normal to the axis of shaft 30 and generally congruent to the disc 25, having one face 33 in facing engagement with the face 26 of disc 25, in the condition shown in FIG. 3.

Further, the enlargement or disc 32 is provided on its face 33 toward the disc 25 with a plurality of bulbuous protrusions, semi-spherical protrusions or engagers 34 arranged in a circular or annular array in angularly spaced concentric relation with respect to the disc 32. Further, the semi-spherical projecting engagers 34 may be equal in number to the recessed receivers 37 for respective engagement in the latter as illustrated in FIG. 3.

In addition, there is provided a concentric extension, key or spline 35, say in the form of a cylindrical slide projecting coaxially from the enlargement surface 33 for slidable engagement into the recess or way 28.

As the tilt rod 16 is journaled for axial rotation, and also freely longitudinally slidable within predetermined limits, the tilt rod 16 and its associated driven element 22 may shift rightward, as seen in FIG. 3, to disengage the projector formations 34 from the receiver formations 27. This will permit of relative rotation between the drive element 21 and driven element 22. However, the key or slide 35 will remain slidably and rotatably within key way or recess 28 to retain the axial alignment of the drive and driven members.

As will be apparent, the driving action is applied between the engaging surfaces of receivers 27 and engagers 34, which engaging surfaces are inclined with respect to the direction of force or torque applied, as by rotation of shaft 23 to effect rotation of tilt rod 16. By this inclinded surface engagement, the projector formations 34 tend to separate or disengage from the receiver formations 27, whereupon the driving element 21 is free to rotate relative to the driven element 22. However, resilient means, generally designated 40, serves to yieldably bias or urge the drive and driven elements 21 and 22 with their receiver and projector formations 27 and 34 into interengagement with each other. The resilient means 40 may be constituted of a spring member, including a medial or base portion 41 suitably secured fast to the bottom wall 42 of headrail 15, and a pair of upstanding resilient leaves or end portions 43 and 44 on opposite sides of the enlargements 25 and 32. In particular, the resilient leaf 43 upstands from one side of the base portion 41 on one side of the enlargement 25 remote from the enlargement 32, and the other leaf 44 upstands from the base on one side of the enlargement 32 remote from the enlargement 25. The leaf 43 is cut away, as at 45 to receive in the cut away region ghe shank or shaft 23, and leave of the remaining material a pair of spaced resilient fingers or legs 46 having their free ends resiliently biased into bearing engagement with the adjacent enlargement 25, approximately on opposite sides of the axis thereof. Similarly, the leaf 44 is cut away, as at 47 to define a notch or opening receiving the shank or shaft 30, and defines laterally spaced legs or fingers 48 in resilient bearing engagement with the adjacent enlargement 32. Thus, the enlargements 25 and 32 are resiliently biased toward each other to yieldably retain their formations 34 and 27 in engagement, and effect a driving connection between the tilt operator 17 and tilt rod 16. However, upon a predetermined value of tilt rod rotation resistance, the enlargements 25 and 32 tend to separate, as by the inclined bearing surfaces between engagers 34 and receivers 27, to shift the enlargements apart against the resilient action of leaves 43 and 44 for relative rotative movement and slippage between the enlargements. Of course, upon reduced resistance to tilt rod rotation, the interfitting formations 34 and 27 again re-engage to effect tilt rod driving action.

From the foregoing, it will be seen that there is provided by the instant invention a slip coupling means or clutch for a venetian blind tilting system, which is extremely simple in construction, foolproof in operation, economical to manufacture and install, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. The combination with a venetian blind including a rotary tilt rod for tilting slats and operating means for rotating said tilt rod, of coupling means interposed between said operating means and tilt rod, said coupling means comprising a drive element nonrotatably connected to said operating means for rotation therewith, a driven element nonrotatably connected to said tilt rod for rotation with the latter, separable interfitting formations on said drive and driven elements configured to effect driving engagement and urging said formations apart when in their interfitting relation and driving engagement, and resilient spring clip means of predetermined spring constant embracingly astride said drive and driven elements and urging said formations toward their interfitting relation, for driving said tilt rod by said operating means at a less than predetermined value of tilt rod resistance and disengaging said tilt rod from said operating means at a tilt rod resistance greater than said predetermined value.

2. The combination according to claim 1, said resilient spring clip means comprising a generally U-shaped resilient member having a pair of legs on opposite sides of said drive and driven elements.

3. The combination according to claim 2, said formations including concentric annular arrays of receivers on one of said drive and driven elements and engagers projecting integrally from the other of said elements and engaging in said receivers, and said spring clip means resiliently biasing said engagers into said receivers.

4. The combination according to claim 3, said receivers opening longitudinally of said tilt rod in one direction, and said engagers projecting generally longitudinally of said tilt rod in the other direction.

5. The combination according to claim 2, said formations each including an enlargement generally normal to the tilt rod and shiftable toward and away from each other, and annular arrays on said enlargements and concentric with said tilt rod of receivers and engagers removably engaging in said receivers when said enlargements are moved toward each other, and said spring clip resiliently engaging and biasing said enlargements toward each other.

6. The combination according to claim 5, in combination with way means in one of said enlargements opening toward the other enlargement, and a slide projecting from the other enlargement and slidable in said way means to retain said enlargement in aligned relation.

7. The combination according to claim 6, said way means comprising a central recess, and said slide projecting slidably and rotatably into said central recess.

8. The combination according to claim 6, said enlargements each comprising a disc generally concentric with the axis of said tilt rod, said receivers comprising holes in one disc, and said engagers comprising intergral protrusions on the other of said discs.

9. The combination according to claim 8, said engager projections and receiver holes having engaging surfaces in inclined relation to the driving force for effecting said separation upon excessive driving force.

* * * * *